US007588382B2

(12) United States Patent
Sato et al.

(10) Patent No.: US 7,588,382 B2
(45) Date of Patent: Sep. 15, 2009

(54) SHEET PROCESSING APPARATUS AND IMAGE FORMING APPARATUS

(75) Inventors: Akihiro Sato, Kawasaki (JP); Hyoe Iwata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 341 days.

(21) Appl. No.: 11/499,729

(22) Filed: Aug. 7, 2006

(65) Prior Publication Data

US 2007/0036597 A1 Feb. 15, 2007

(30) Foreign Application Priority Data

Aug. 8, 2005 (JP) ..... 2005-229176

(51) Int. Cl.
*B41J 11/00* (2006.01)

(52) U.S. Cl. ..... 400/621; 399/407

(58) Field of Classification Search ..... 399/385, 399/407; 400/621; 83/73, 76, 76.1, 76.6, 83/76.7, 76.8
See application file for complete search history.

(56) References Cited

U.S. PATENT DOCUMENTS 3,620,114 A * 11/1971 Chudyk ..... 83/107
4,266,121 A * 5/1981 Hirose ..... 235/381
6,459,864 B2 * 10/2002 Kasai et al. ..... 399/82
6,520,701 B2 * 2/2003 Kaya ..... 400/621
7,137,625 B2 * 11/2006 Yamada et al. ..... 270/58.07
7,360,958 B2 * 4/2008 Awano ..... 400/621
7,413,360 B2 * 8/2008 Kikuchi ..... 400/621
7,467,793 B2 * 12/2008 Tanabe ..... 271/245
2005/0082735 A1 4/2005 Nakamura et al. ..... 271/1
2005/0084308 A1 4/2005 Nakamura et al. ..... 399/407

FOREIGN PATENT DOCUMENTS

JP 10-076495 * 9/1996
JP 10-76495 3/1998
JP 200001027 * 6/1998
JP 2000-10207 1/2000

* cited by examiner

*Primary Examiner*—Ren Yan
(74) *Attorney, Agent, or Firm*—Fitzpatrick, Cella, Harper & Scinto

(57) ABSTRACT

An object of this invention is to provide a sheet processing apparatus capable of cutting a sheet and recording information on the back surface of the sheet without enlarging the size of the apparatus and dropping productivity. The sheet processing apparatus which executes a predetermined processing on a sheet in which an image is recorded includes: a cutter for cutting a sheet; and a print unit for recording an information about recording to the front surface the sheet on the back surface of the sheet, wherein an action of cutting the sheet with the cutter and an action of recording on the back surface of the sheet with the print unit are executed in parallel.

10 Claims, 5 Drawing Sheets

SHEET PROCESSING APPARATUS AND IMAGE FORMING APPARATUS

BACKGROUND OF THE INVENTION

1. Field of the Invention

The present invention relates to a sheet processing apparatus for executing a predetermined processing on a sheet on which an image is formed and an image forming apparatus provided with this sheet processing apparatus.

2. Description of the Related Art

In recent years, an electrophotographic type image forming apparatus for forming a high quality image such as silver halide photography has been developed. In such an image forming apparatus, a L-size (photographic size) smaller than postcard-size cannot be used. Thus, a conventional image forming apparatus has adopted a method in which a photographic image is imposed on the A4 size sheet and this sheet is cut into a predetermined dimension if the photographic size like the L size is desired as an output object. As a cutting device for cutting this sheet into a specified dimension, technology disclosed in Japanese Patent Application Laid-Open No. 10-76495 has been generally known. According to Japanese Patent Application Laid-Open No. 10-76495, an output object on which an image is recorded with an image forming apparatus or the like is placed on a supporting base plate of the cutting device off line and then cut into a predetermined dimension.

When an output object same as a certain output object of those created in the above-described manner is produced again, the color and density of the output object needs to substantially coincide with those of the output object created in advance. However, it is often difficult for an operator not skilled in image processing to output an image having the same quality as the preceding output object, thereby taking a long time for that processing, so that waste of material increases due to generation of unacceptable printed products.

To meet such a problem, a print system capable of outputting a print image having the same color and density as a previous output product has been proposed. For example, the print system disclosed in Japanese Patent Application Laid-Open No. 2000-10207 records image processing information indicating an image processing method applied to each image on the back surface of an output product when printing an input image such as an image taken with a digital camera or the like. Then, when creating a print having the same color and density as that output product, the image processing information of the output product to be reproduced again is read from the back surface of the output product and the same image processing is executed based on that information.

However, if the cutting device disclosed in Japanese Patent Application Laid-Open No. 10-76495 and the print system disclosed in Japanese Patent Application Laid-Open No. 2000-10207 are connected as an electrophotographic type image forming apparatus capable of cutting an output product and recording image processing information on the back surface of the output product, the size of the entire apparatus increases, which is a problem to be solved. Further, productivity the cutting device connected to the aforementioned print system becomes a considerably low because it cuts output products off line. Even if the cutting device is so constructed as to cut the output products on line, its productivity of printing is still low because the size of the apparatus is large. Further, the above-mentioned combination of the cutting device and apparatus induces a further drop in productivity because the output product needs to be stopped for each of both the cutting operation and the recording operation to the back surface of the product.

SUMMARY OF THE INVENTION

Accordingly, an object of the present invention is to provide a sheet processing apparatus and image forming apparatus capable of cutting a sheet and recording information on the back surface of a sheet without enlarging the size of the apparatus and drop of productivity.

To achieve the above-described object, the present invention provides a sheet processing apparatus for executing a predetermined processing on a sheet in which an image is recorded, comprising: a cutting unit which cuts a sheet; and a recording unit which records an information about recording to the front surface of the sheet on the back surface of the sheet, wherein an action of cutting the sheet with the cutting unit and an action of recording on the back surface of the sheet with the recording unit are executed in parallel.

The present invention enables cutting of the sheet and recording of information on the back surface of the sheet without a necessity of enlarging the size of the apparatus and dropping productivity.

DESCRIPTION OF THE EMBODIMENTS

Hereinafter, the preferred embodiments of the present invention will be described in detail with reference to the accompanying drawings.

First Embodiment

An image forming apparatus having a sheet processing apparatus according to the first embodiment of the present invention will be described with reference to FIGS. 1 to 5.

(Entire Structure of Image Forming Apparatus)

Figure 1:
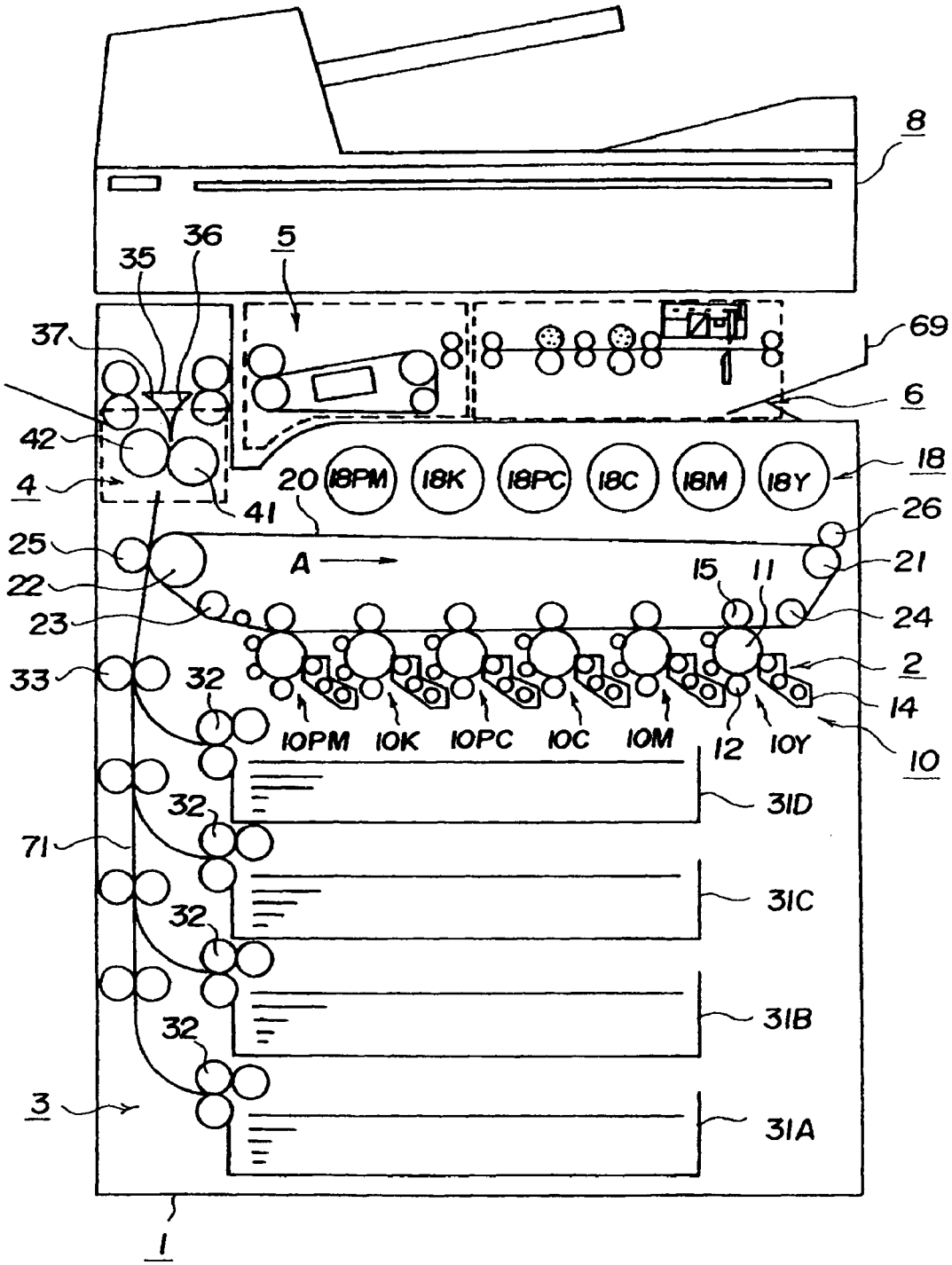
FIG. 1 is a schematic sectional view of an image forming apparatus.

First, the entire structure of the image forming apparatus according to this embodiment will be described. FIG. 1 is a schematic sectional view showing the image forming apparatus according to the first embodiment of the invention.

According to this image forming apparatus, an image creating system (image formation part) 2 using intermediate transfer system, a sheet feeding unit 3 for supplying recording sheets and a first fixing device 4 and the like are disposed within its casing 1 constituting a main body of the apparatus. An original reading device 8 and an operation portion (not shown) are disposed above the casing 1 with a space there between. The space between the top of the casing 1 and the original reading device 8 serves as an in-apparatus sheet discharge portion in which sheets discharged from the casing 1 are supported. Further, a sheet processing apparatus for executing a predetermined processing on a sheet in which an image is recorded is attached to this space detachably. This sheet processing apparatus includes a belt fixing device 5 as a gloss applying unit for applying gloss to the sheet and a cutting device 6 for cutting the sheet. The cutting device 6 is disposed in the downstream side of the belt fixing device 5 in the conveyance direction of the sheet.

In this image forming apparatus, a predetermined selective instruction is made from an operation panel (not shown). As a result, first output mode (normal print mode) for executing normal image output or second output mode (photographic print mode) for outputting an image with gloss can be selected.

In this image forming apparatus, an image forming process pattern peculiar to each output mode is selectively setup. That is, if the normal print mode is selected upon formation of an image, a pattern for discharging without sending to the belt fixing device 5 is selected after the image is fixed with the first fixing device 4. On the other hand, when the photographic print mode is selected, a process pattern for executing gloss processing with the belt fixing device 5 is selected after the image is fixed with the first fixing device 4.

(Configuration of Image Forming System)

The image creating system 2 as a image formation part includes image creating units 10Y, 10M, 10C, 10PC, 10K and 10PM for forming toner images of six colors, yellow (Y), magenta (M), cyan (C), photo cyan (PC), black (K) and photo magenta (PM). The image creating system 2 has an intermediate transfer belt 20 for transferring toner images formed by these six image creating units 10 to transfer positions to a recording sheet.

The respective image creating units 10 have the same structure. The structure of the image creating unit 10Y will be described. The image creating unit 10Y includes a photosensitive drum 11 having organic photosensitive layer or the like on its surface and a non-fixed toner image is formed on the photosensitive drum 11 through a following electrophotographic process. That is, the surface of the rotating photosensitive drum 11 is charged equally by a charging device 12 such as a roller type. After that, the charged surface is scanned with laser beam based on an image creating data signal described later from exposing device (not shown) so as to form an electrostatic latent image. Next, the latent image is developed with toner component of developing agent supplied from the developing unit 14 so that a toner image of a predetermined color is represented.

The toner image formed by each image creating unit 10 is transferred primarily to an intermediate transfer belt 20 passing between each photosensitive drum 11 and the primary transfer roller 15 electrostatically. The surface of each photosensitive drum 11 after transfer is neutralized with a neutralizing unit (not shown) such as lamp type after it is cleaned with a drum cleaning unit (not shown). Reference numeral 18 (Y, M, C, PC, K, PM) denotes a toner cartridge containing toner to be supplied to the developing unit 14 of each image creating unit 10.

(Structure of Intermediate Transfer Belt)

The intermediate transfer belt 20 is an endless belt composed of polyimide film whose volume resistivity is adjusted by adding conductive material or the like. Then, this intermediate transfer belt 20 is stretched between a drive roller 21, a backup roller 22 of a secondary transfer portion and a plurality of driven rollers 23, 24. The intermediate transfer belt 20 is disposed such that it makes contact with the photosensitive drums 11 of the respective image creating units between the driven rollers 23 and 24 and rotated in the direction of an arrow A.

(Structure of Sheet Feeding Unit)

The sheet feeding unit 3 includes a plurality of sheet cassettes 31A, 31B, 31C, 31D which accommodate a plurality of recording sheets separately depending on the size. This sheet feeding unit 3 feeds each recording sheet from the sheet cassette 31 by unit of the sheet sending device 32. This recording sheet is conveyed to a resist roller 33 through a sheet conveyance path 71 constituted of a plurality of conveyance rollers, guide members and the like. After that, the recording sheet is sent to a secondary transfer position meeting a secondary transfer timing by unit of the resist roller 33.

The recording sheet is not restricted to any particular one as long as it can be conveyed within this image forming apparatus and the toner image can be transferred and fixed. As this recording sheet, usually, a plain sheet or coated sheet of specified size such as A4, B5 is used. Such a sheet is used when an image is formed under the above-mentioned normal print mode.

The toner image transferred to the intermediate transfer belt 20 is conveyed to the secondary transfer position between a secondary transfer roller 25 disposed to oppose the backup roller 22 and the belt 20 in a condition in which it is carried by the belt 20. The toner image is transferred secondarily to a recording sheet of a predetermined size supplied to the secondary transfer position from the sheet cassette 31 electrostatically. The surface of the intermediate transfer belt 20 after the secondary transfer is cleaned by unit of a belt cleaning unit 26.

(Structure of First Fixing Device)

A heating roller 41 and a pressure belt 42 are disposed in a pressure contact condition within the first fixing device 4. In the heating roller 41, elastic layer and toner parting layer are formed on a metallic cylindrical roller composed of aluminum or the like while a heating source such as a halogen lamp is disposed within the roller. In the pressure belt 42, the separation layer is formed on a belt base material composed of polyimide film or the like. A pressure pad for forming a nip by pressing the belt to the heating roller 41 is disposed within the pressure belt 42.

There are provided a conveyance path 36 for conveying the recording sheet after the first fixing is finished to the belt fixing device 5 and a conveyance path 37 which branches the recording sheet halfway of the conveyance path 36 and discharges the recording sheet to a discharge tray outside the casing 1 in the downstream side of the first fixing device 4.

After the toner image is transferred secondarily, the recording sheet is heated and pressurized when it passes the nip between the heating roller 41 and the pressure belt 42 after it is sent into the first fixing device 4. Consequently, the toner image is fixed to the recording sheet. After the first fixing is finished by the first fixing device 4, the recording sheet is conveyed through any of following process patterns. According to one pattern, when the aforementioned normal print mode is selected, the recording sheet is sent to the conveyance path 37 for discharge by a guide of a conveyance direction switching gate 35 and discharged out of the casing by a discharge roller. According to another pattern, when the aforementioned photographic print mode is selected, the recording sheet is sent to the conveyance path by a guide of the conveyance direction switching gate 35 and discharged to the in-apparatus sheet discharge portion or sent to a sheet processing apparatus.

(Structure of Original Reading Device)

The original reading device 8 reads out reflected light of an image from the original with a CCD sensor by irradiating an original to be copied with light source, executes a predetermined image signal processing on the signal and inputs that signal as image data. The image data read by this original reading device is sent to an image processing unit (not shown) through a transmission cable. This image forming apparatus includes a memory medium reading unit for inputting image data recorded in a memory medium, a communication input unit for inputting image data created by an external connection device through communication cable, radio or the like, and the like so as to fetch these image data. Particularly, image pickup data of a digital camera can be fetched in.

A variety of image data input from this original reading device 8, the memory medium reading device and communication input unit are converted to image creation data through a predetermined image processing (color conversion processing, resolution processing, magnification changing processing, processing/editing processing and the like) in image processing unit. Further, the converted image creation data is sent to an exposing unit (not shown) in the image creating system 2 and used for the above-described image creation process.

This image forming apparatus overlays toner images of six colors formed by the six image creating units 10 (Y, M, C, PC, K, PM) on the intermediate transfer belt 20 successively to achieve the primary transfer. After that, the multiple toner images are transferred secondarily to the recording sheet in batch so as to form a full-color image. Further, a single color image such as a monochrome image may be formed by transferring a black toner image created by actuating only part of the image creating units, for example, the image creating unit 10K for black of the six image creation units 10 (Y, M, C, PC, K, PM) to the recording sheet through the intermediate transfer belt 20.

(Structure of Belt Fixing Device)

The belt fixing device 5 is used in conditions in which it is disposed at in-apparatus portion of a space between on the top of the casing 1 of the image forming apparatus and the original reading device 8.

Although the belt fixing device 5 functions as a unit for providing with gloss, according to this embodiment, it is disposed in the downstream side in the sheet conveyance direction of the first fixing device 4 disposed within the casing 1 and used as a second fixing device.

Figure 2:
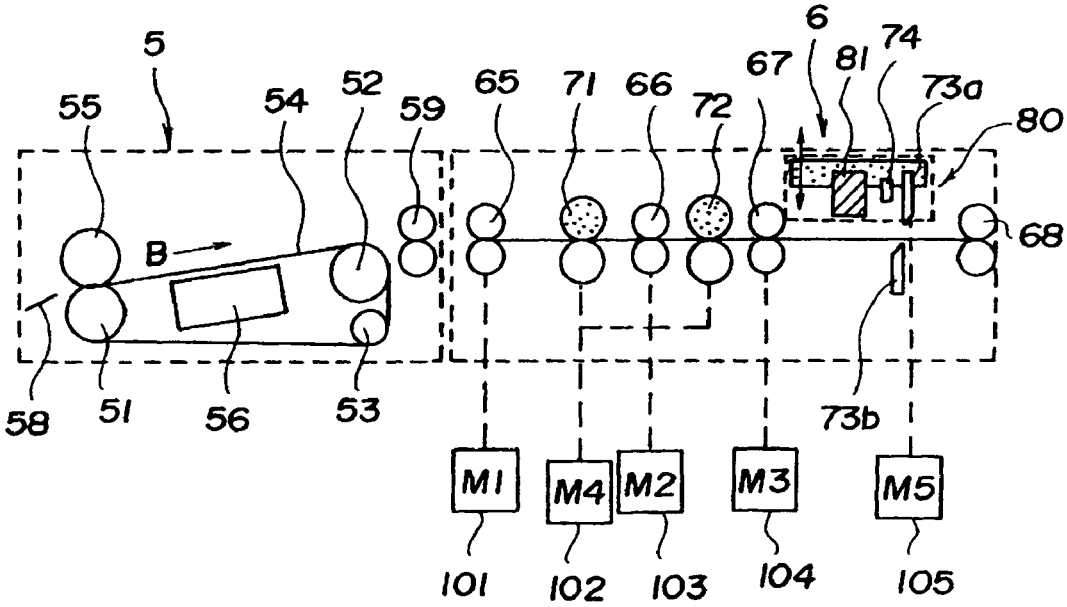
FIG. 2 is a schematic sectional view of a sheet processing apparatus.

As shown in FIG. 2, the belt fixing device 5 includes a fixing belt 54 which rotates in the direction of an arrow B. The fixing belt 54 is applied around a heating roller 51, a separation roller 52 and a steering roller 53. Further, the belt fixing device 5 includes a pressure roller 55 for forming a nip by pressing the fixing belt 54 to the heating roller 51 and a cooling device 56 for cooling a portion in the downstream side of the nip of the fixing belt 54.

The heating roller 51 and the pressure roller 55 constitute a heating and pressurizing units. In the heating roller 51, a metallic cylindrical roller having a high heat conductivity is coated with elastic layer and a heating source such a halogen lamp is disposed within that roller. On the other hand, in the pressure roller 55, a metallic cylindrical roller having a high heat conductivity is coated with elastic layer and separation layer in this order and a heating source such as a halogen lamp is disposed within the roller.

The separation roller 52 separates the recording sheet from the fixing belt 54 by the stiffness of the sheet it self. The external dimensions of this separation roller 52 are determined depending on adhesion force between the fixing belt 54 and the recording sheet and a winding angle between the fixing belt 54 and the separation roller 52.

The steering roller 53 aims at moving and adjusting the fixing belt 54 by a predetermined amount in a direction perpendicular to a rotation direction (direction of an arrow B) so as to make the fixing belt 54 pass a predetermined position in the direction perpendicular to the rotation direction.

The fixing belt 54 is produced by coating an endless film composed of thermosetting type polyimide with surface layer composed of silicone rubber smooth in its surface. The cooling device 56 is used for cooling the recording sheet adhering to the fixing belt 54 practically. This cooling device 56 is disposed in an inside area of the fixing belt 54 between the heating roller 51 and the separation roller 52 so as to absorb heat from the fixing belt 54 in a condition in which it makes a contact with its inner peripheral face.

A guide 58 is disposed in the upstream side of the belt fixing device 5 in the sheet conveyance direction via the fixing belt 54 and the conveyance roller 59 is disposed in the downstream side.

(Structure of Cutting Device)

Figure 3:
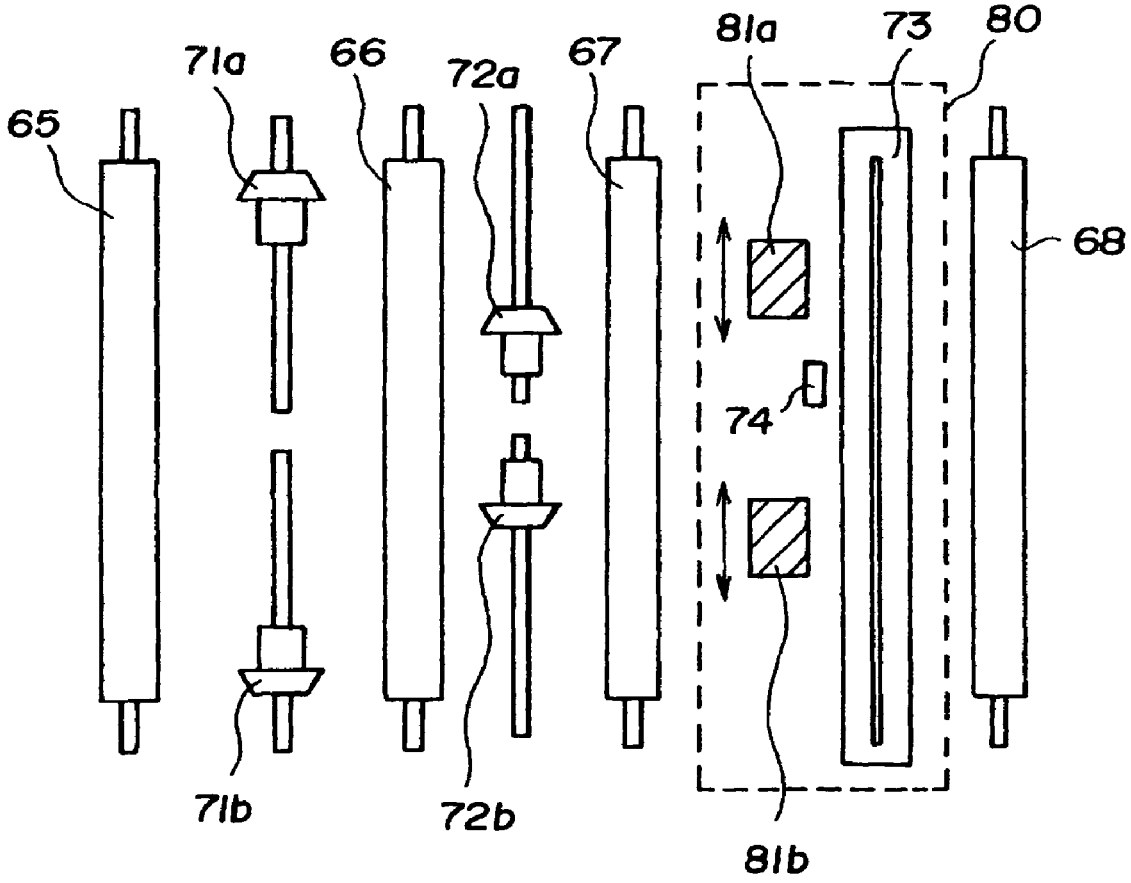
FIG. 3 is a schematic top view of a cutting device.

FIG. 2 is a side sectional view of the cutting device 6 of this embodiment. FIG. 3 is a top view of the cutting device 6. A conveyance roller 65 is disposed in the upstream side of the cutting device 6 in the sheet conveyance direction. The conveyance roller 65 is driven by a drive motor 101. A pair of rotary wheel type cutters 71*a*, 71*b* as a second cutting unit for cutting the recording sheet and a pair of rotary wheel type cutters 72*a*, 72*b* are disposed in the downstream side of the conveyance roller in the sheet conveyance direction. The conveyance rollers 66 is disposed between the rotary wheel type cutters 71 and 72. The conveyance rollers 67 is disposed in the downstream side of the cutters 72. The conveyance rollers 66, 67 are driven independently by drive motors 103, 104. The cutters 71, 72 are driven by a motor 102. The cutters 71*a*, 71*b* and type cutters 72*a*, 72*b* are independent and movable in a direction perpendicular to the sheet conveyance direction. Although the cutters 71*a*, 71*b* and the cutters 72*a*, 72*b* are disposed separately in the upstream and downstream side, they may be provided coaxially. Although the cutters 71*a*, 71*b* are provided to cut both side ends of the sheet and the cutters 72*a*, 72*b* are provided to cut the sheet central portion, both of them do not need to be provided but only any one of them may be provided depending on the size of the recording sheet for use. In the embodiment, the structure in which the rotary wheel type cutter for cutting the sheet with a disk-like cutter is adopted is described, but the invention is not limited to this structure. For example, a guillotine type cutter which is described later may be used.

A guillotine type cutter unit 80 is disposed in the downstream side of the conveyance roller 67. This guillotine type cutter unit 80 includes printing devices 81*a*, 81*b* as a recording unit, the cutter 73 as a first cutting unit and a sheet detecting sensor 74 provided integrally. The cutter 73 is driven by a motor 105. The cutter 73 cuts the recording sheet in a direction perpendicular to the sheet conveyance direction. Although according to this embodiment, the printing device 81 and the cutter 73 are integrated into a unit with the cutter unit 80, the present invention is not restricted to this example. For example, it is permissible to integrate the printing device 81 with the cutters 71, 72 for cutting the recording sheet in the sheet conveyance direction. Further, it is not necessary to equip both the cutter 73 and the cutters 71, 72 as cutting units and any one of them may be integrated with the printing device 81 depending on the size of the recording sheet for use. Although all of them may be integrated into a single unit, it is preferable to construct a minimum unit structure necessary from viewpoints of miniaturization.

Figure 4:
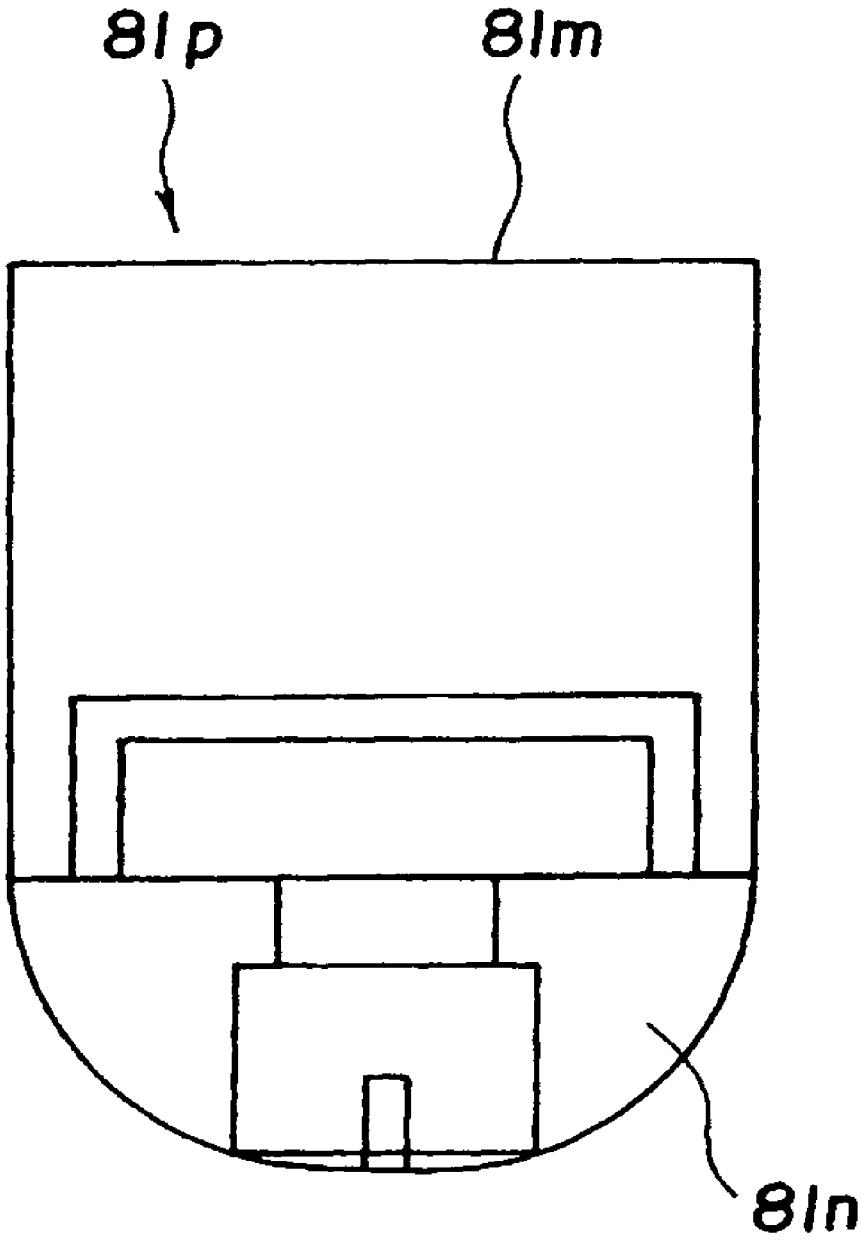
FIG. 4 is a construction diagram of a print device.

The printing device 81 records information about image recorded to the front surface of a sheet and information about print condition and the like on the back surface of the recording sheet. According to this embodiment, as shown in FIG. 4 dot printing method in which a print head 81*m* forms dots successively by rotating an ink ribbon 81*n* installed on a dot printing device main body 81*p* is employed. In the meantime, the recording method is not restricted to the above-described method, but may be other recording method.

The printing devices 81*a*, 81*b* are movable in the direction perpendicular to the sheet conveyance direction independently. Time required for a recording operation can be reduced by providing plural printing devices such that they are movable independently. This print unit can meet various sizes from a small one to a large one by disposing the printing devices in line in the direction perpendicular to the sheet conveyance direction. The guillotine type cutter 73 cuts the recording sheet in the direction perpendicular to the sheet conveyance direction. The sheet detecting sensor 74 is a detecting portion for detecting the front end in the conveyance direction of the sheet.

The rotary wheel type cutters 71, 72 are disc-like cutting blades and each comprised of a pair of upper wheel blade and lower wheel blade, located up and down. The cutters 71, 72 are installed freely rotatably on a predetermined position of supporting shafts disposed up and down in parallel in the direction perpendicular to the sheet conveyance direction such that the upper wheel blade and lower wheel blade cross each other while partially in contact within the recording sheet conveyance path. Cutting by the cutters 71, 72 is automatically carried out when the recording sheet is passes the portion in which the upper wheel and lower wheel cross each other in a contact condition.

The guillotine type cutter 73 is a sheet-like cutting blade which includes a pair of a movable blade 73*a* and a fixed blade 73*b*. In this cutter 73, the movable blade 73*a* and the fixed blade 73*b* are disposed in parallel at a predetermined gap along the sheet conveyance direction and they are disposed up and down in the direction perpendicular to the conveyance direction. The fixed blade 73*b* is disposed to be located in the conveyance path of the recording sheet. On the other hand, the movable blade 73*a* is fixed to the cutter unit 80 and the cutter unit 80 can be displaced in a direction (vertical direction) of approaching to/parting from the fixed blade 73*b*. Then, the movable blade 73*a* and the fixed blade 73*b* are so constructed to approach and cross each other so as to cut the recording sheet. In this cutting operation with the cutter 73, the front end in the conveyance direction of the recording sheet is detected with the sheet detecting sensor 74 and the recording sheet is stopped and cut after a predetermined timing.

The movable blade 73*a* and the printing device 81 are so constructed to move to an actuation position which allow them to be actuated and a non-actuation position which block them from being actuated. That is, the printing device 81 is displaced vertically at the same time as a cutting timing of the cutter 73. When the cutter unit 80 descends (moves to the actuation position) so that the recording sheet is cut out by the cutter 73, the printing device 81 prints on the back surface of the recording sheet. That is, an action of cutting the recording sheet with the cutter 73 as a cutting unit and an action of recording on the back surface of the recording sheet with the printing device 81 as a recording unit are carried out in parallel.

(Description of Operation)

Figure 5:
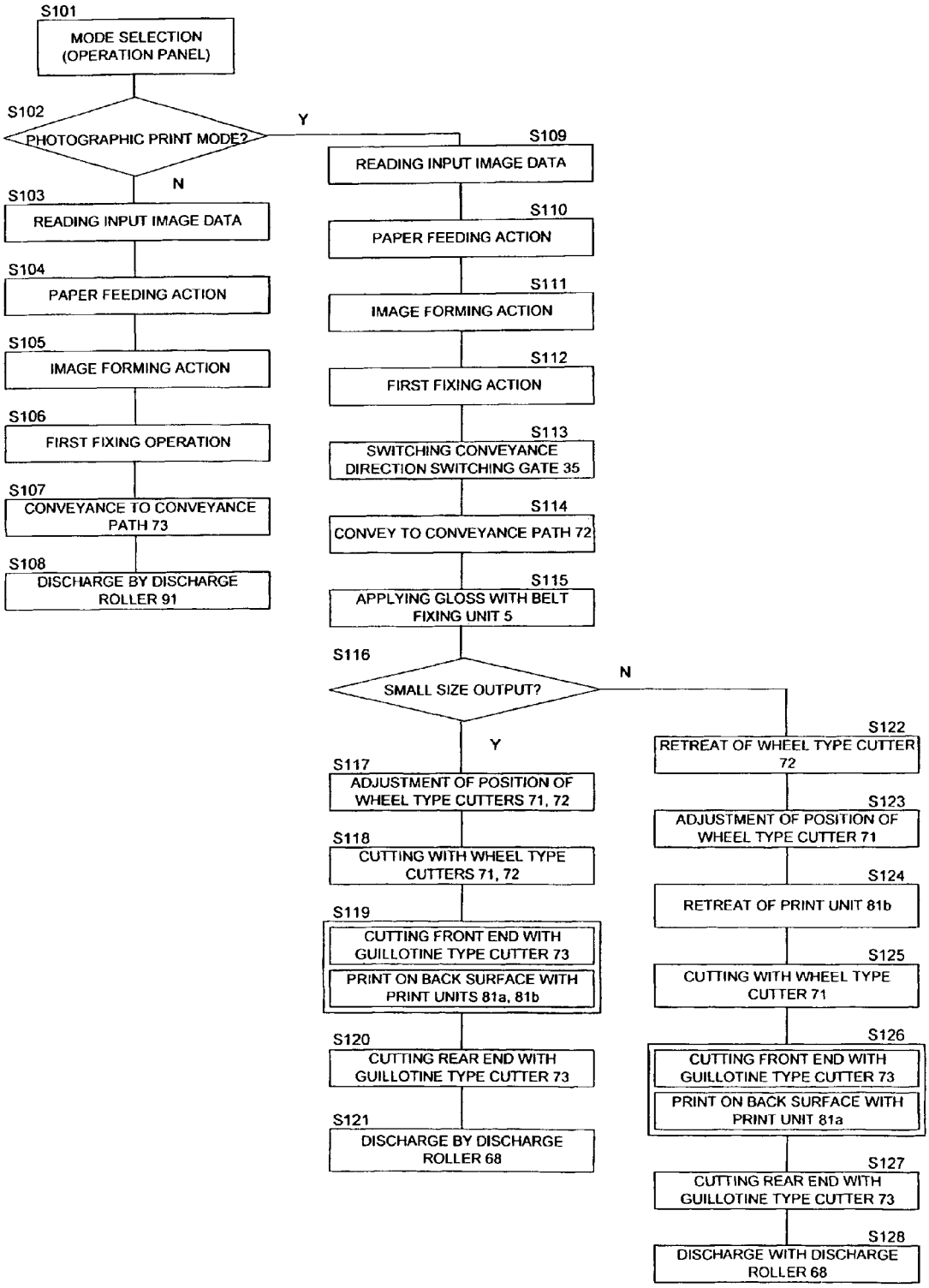
FIG. 5 is a flow chart for explaining the operation of an image forming apparatus.

Next, the operation of the above-described image forming apparatus will be described. FIG. 5 is a flow chart for explaining the operation.

First, a predetermined selection instruction is carried out from an operation panel (not shown) (S101, S102). Normal print mode for executing normal image output or photographic print mode is selected. If the normal image output is executed, the recording sheet feeding operation is carried out (S104) after input image data is read in (S103) so as to execute image formation action (S105). After that, first fixing is executed with the first fixing device 4 (S106) and the recording sheet is discharged by a discharge roller 91 via the conveyance path 37 (S107, S108).

Next, a case where photographic print mode is selected will be described. This photographic print mode is the same as the normal print mode for executing the normal image output (S102-S106) up to the first fixing action (S109-S112). After the first fixing action is finished, the recording sheet discharged from the first fixing device 4 is conveyed to the belt fixing device 5 by the conveyance direction switching gate 35 (S113, S114). At this time, the recording sheet is conveyed to the belt fixing device 5 with a front surface of the sheet (sheet surface) on which photographic type print is made, facing down in contact with the fixing belt 54.

Following gloss applying processing is carried out by the belt fixing device 5 (S115). First, the recording sheet is heated and pressurized when it passes a nip between the fixing belt 54 and the pressure roller 55 and after it passes the nip, conveyed in a condition in which it adheres to the fixing belt 54. Subsequently, the sheet adhering to the fixing belt 54 is cooled up to a predetermined temperature by the cooling device 56 and after that, separated from the fixing belt 54 at the separation roller 52. Consequently, a toner image fixed to the first fixing device 4 is fixed to the recording sheet with feeling of gloss given to the toner image as a result of transfer a smooth surface of the fixing belt 54.

Next, the recording sheet discharged from the belt fixing device 5 by the conveyance roller 59 is conveyed to the cutting device 6. The cutting device 6 adopts a different sequence depending on a large size like size A4 or a small size like size L (S116).

When a small size sheet like size L is created by cutting, the rotary wheel type cutters 71, 72 move in the direction perpendicular to the sheet conveyance direction depending on the size of an output sheet input by the operation panel and stands by at a desired position (S117). Then, the recording sheet conveyed to the cutting device 6 is conveyed within the unit by the conveyance rollers 65, 66. In this while, both side ends of the sheet are cut down when the recording sheet passes the cutter 71 (S118). Further, the sheet central portion is cut when the recording sheet passes the cutter 72 (S118). The central portion of the recording sheet is cut in order to create four sheets of size L from a recording sheet of size A4.

On the other hand, if a large size sheet like size A4 is created, the cutter 72 is retreated to a cutting impossible position because the central portion of the recording sheet does not need to be cut (S122). On the other hand, the cutter 71 is adjusted to a desired position and stands by depending the size of an output sheet input through the operation panel (S123). The printing device 81*b* which cancels its print action of the plural printing devices 81*a*, 81*b* is moved from a sheet passage area to the retreat position corresponding to the retreat action of the cutter 72 (S124). The recording sheet conveyed to the cutting device 6 is conveyed within the apparatus by means of the conveyance rollers 65, 66 and both side ends of the sheet are cut out when the recording sheet passes the rotary wheel type cutter 71.

When a predetermined time elapses since the front end portion of the recording sheet is detected by the sheet detecting sensor 74, the sheet conveyance action of the conveyance rollers 65 to 68 is stopped temporarily. The movable blade 73*a* of the guillotine type cutter 73 descends after the sheet conveyance action is stopped and approaches and crosses the fixed blade 73*b*. Consequently, the front end side of the recording sheet is cut in the direction perpendicular to the sheet conveyance direction (S119 or S126). Information about recording to the front surface of the sheet (image No. of surface image file, color correction data at the print time and the like) is recorded on the back surface of the recording sheet by the printing devices 81*a*, 81*b* while moving the print units 81*a*, 81*b* in the direction perpendicular to the sheet conveyance direction with the movable blade 73*a* descended (S119 or S126). Necessity of stopping the recording sheet for cutting action and recording action is eliminated by executing the recording action on the back surface of the recording sheet synchronously with the up/down motion of the movable blade 73*a*. That is, cutting of the sheet and recording of information on the back surface of the sheet are enabled without dropping productivity.

The sheet conveyance action of the conveyance rollers 65 to 68 is restarted when cutting of the rear end of the recording sheet with the guillotine type cutter 73 is terminated (S120 or S127). After that, a cut recording sheet is discharged to the discharge tray 69 by the conveyance roller 68.

According to this embodiment, as described above, the cutter 73 and the printing device 81 are provided integrally as the unit 80 and the action of cutting the recording sheet with the cutter 73 and the action of recording on the back surface of the recording sheet with the printing device 81 are executed in parallel. Consequently, cutting of the sheet and recording of information on the back surface of the sheet are enabled without enlarging the size of the apparatus and dropping productivity.

Other Embodiment

Although according to the above-described embodiment, the recording action is carried out by the printing device 81 during the cutting action of the guillotine type cutter 73, the guillotine type cutter 73 may cut out during the recording action of the printing device 81. Any structure may be adopted if the cutting action by the guillotine type cutter 73 and the recording action by the printing device 81 are executed in parallel.

Although the above-described embodiment exemplifies a structure in which the sheet processing apparatus including the cutter as a cutting unit and the printing device as a recording unit is disposed detachably in the apparatus of the image forming apparatus, the present invention is not restricted to this example. The structure in which sheet processing apparatus is disposed detachably outside of the image forming apparatus. At this time, the belt fixing device 5 as a gloss applying unit is disposed outside of the image forming apparatus and further disposed in the upstream of the cutting device 6.

Although according to the above embodiment, two printing devices are provided as the recording unit, the present invention is not restricted to this example, but a printing device may be permitted. In this case, the printing device is provided to be movable in the direction perpendicular to the sheet conveyance direction or the width of a print area in the direction perpendicular to the sheet conveyance direction of the printing device is set substantially same as the width of a sheet which can be conveyed.

Although the above embodiment exemplifies the sheet processing apparatus which is attached detachably to the image forming apparatus, the present invention is not restricted to this example. For example, the sheet processing apparatus may be included in the image forming apparatus and when the present invention is applied to the sheet processing apparatus, the same advantage can be expected.

Although the above embodiment exemplifies a structure in which the image creating system as an image formation part includes six image creating units, the quantity of the image creating units is not restricted to this example, but may be set up appropriately depending on a necessity.

Although the above embodiment exemplifies a copying machine as the image forming apparatus, the present invention is not restricted to this example, but it is permissible to adopt for example, a printer, facsimile machine or the like as other image forming apparatus. Alternatively, other image processing apparatus such as a complex machine which combines these functions may be adopted. The image forming apparatus may be so constructed to adopt a transfer material bearing member which bears and transfer a sheet and transfer toner images of respective colors to the transfer material borne by the transfer material bearing member successively such that they are overlaid. By applying the present invention to the sheet processing apparatus for use in such an image forming apparatus, the same effect can be obtained.

This application claims the benefit of priority from the prior Japanese Patent Application No. 2005-229176 filed on Aug. 8, 2005 the entire contents of which are incorporated by reference herein.

What is claimed is:

1. A sheet processing apparatus, connected to an image forming apparatus which forms an image on a sheet, which executes a predetermined processing on a sheet comprising:

a conveyance member for conveying an image formed sheet from the image forming apparatus;

a first cutting unit which cuts the conveyed image formed sheet in a direction perpendicular to a sheet conveyance direction;

a second cutting unit which cuts the conveyed image formed sheet along the sheet conveyance direction; and a recording unit which records a recording information about the image formed to the front surface of the conveyed image formed sheet on the back surface of the conveyed image formed sheet, wherein the recording unit and at least one of the first and the second cutting units are provided integrally, and wherein an action of cutting the conveyed image formed sheet with the at least one of the first and the second cutting units provided integrally with the recording unit and an action of recording on the back surface of the conveyed image formed sheet with the recording unit are executed in parallel.

2. The sheet processing apparatus according to claim 1, wherein said at least one of the first and second cutting units and the recording unit moves to an activation position which allows them to be actuated and a non-activation position which prevents them from being actuated at the same time.

3. The sheet processing apparatus according to claim 1, wherein the second cutting unit cuts both side ends of the conveyed image formed sheet along the sheet conveyance direction.

4. The sheet processing apparatus according to claim 1, wherein the second cutting unit cuts the central portion of the conveyed image formed sheet along the sheet conveyance direction.

5. The sheet processing apparatus according to claim 1, wherein the second cutting unit is movable in the direction perpendicular to the sheet conveyance direction.

6. The sheet processing apparatus according to claim 1, said recording unit comprising a plurality of recording units.

7. The sheet processing apparatus according to claim 6, wherein a recording unit which does not executes recording action among the plurality of the recording units is capable of retreating from a sheet passage area.

8. The sheet processing apparatus according to claim 1 wherein the recording unit is provided movably in a direction perpendicular to the sheet conveyance direction.

9. The sheet processing apparatus according to claim 1 further comprising a gloss applying unit for applying gloss to the sheet surface, wherein at least one of the first and second cutting units is disposed in the downstream side of the gloss applying unit in the sheet conveyance direction.

10. An image forming apparatus comprising:

an image formation part which forms an image on a sheet; and the sheet processing apparatus according to claim 1 which executes a predetermined processing on the sheet in which the image is formed by the image formation part.

* * * * *